US008106326B2

(12) United States Patent
Nakauchi et al.

(10) Patent No.: US 8,106,326 B2
(45) Date of Patent: Jan. 31, 2012

(54) GROUNDING SWITCH

(75) Inventors: Shinichiro Nakauchi, Tokyo (JP); Yoshinori Shimizu, Tokyo (JP)

(73) Assignee: Mitsubishi Electric Corporation, Chiyoda-Ku (JP)

( * ) Notice: Subject to any disclaimer, the term of this patent is extended or adjusted under 35 U.S.C. 154(b) by 520 days.

(21) Appl. No.: 12/331,779

(22) Filed: Dec. 10, 2008

(65) Prior Publication Data

US 2009/0166168 A1 Jul. 2, 2009

(30) Foreign Application Priority Data

Dec. 28, 2007 (JP) ..... 2007-341063

(51) Int. Cl.
*H01H 33/00* (2006.01)

(52) U.S. Cl. ..... 218/55; 218/18

(58) Field of Classification Search ..... 218/17–19, 218/55
See application file for complete search history.

(56) References Cited

U.S. PATENT DOCUMENTS

| | | | | |
|---|---|---|---|---|
| 4,484,047 | A * | 11/1984 | Olsen et al. | 218/84 |
| 4,488,022 | A * | 12/1984 | Yoshizumi | 218/16 |
| 4,539,448 | A | 9/1985 | Schulz | |
| 7,919,720 | B2 * | 4/2011 | Shimizu et al. | 218/62 |

FOREIGN PATENT DOCUMENTS

| | | |
|---|---|---|
| JP | 50-46947 U | 5/1975 |
| JP | 62-026724 | 2/1987 |
| JP | 04-049438 U | 4/1992 |
| JP | 07-220550 | 8/1995 |

OTHER PUBLICATIONS

Office Action dated Nov. 26, 2010, issued in the corresponding Canadian Patent Application No. 2,647,861.

* cited by examiner

*Primary Examiner* — Truc Nguyen
(74) *Attorney, Agent, or Firm* — Buchanan Ingersoll & Rooney PC

(57) ABSTRACT

A valley section is provided between a high-voltage arc contact and a high-voltage main contact. Because of the presence of the valley section, resistance between contacts is reduced while a moving arc contact makes contact with the high-voltage arc contact and then slides up to making contact with the high-voltage main contact.

7 Claims, 7 Drawing Sheets

GROUNDING SWITCH

BACKGROUND OF THE INVENTION

1. Field of the Invention

The present invention relates to a grounding switch that is incorporated in gas insulated switchgear.

2. Description of the Related Art

A grounding switch is incorporated in gas insulated switchgear (GIS). The grounding switch is used as a contact in grounding of a main circuit when testing equipment, or as an earth terminal when measuring equipment. When grounding a main circuit, typically, a moving contact, which is grounded, is moved along a center axis of the grounding switch so as to be inserted into a high-voltage electrode, which is connected to high voltage. If, by any possibility, the moving contact moves in an axial direction of the grounding switch and is inserted into a high-voltage electrode as the result of an erroneous operation when high voltage is being applied to the main circuit, there has been a need of a function which is capable of opening the grounding switch afterwards with a reliable earth connection taken and without fusing across electrodes. This is to say that if the moving contact erroneously enters into the high-voltage electrode in a state where a high voltage is applied, an arc occurs due to breakdown of insulation between the electrodes. The surrounding gas therefore reaches a high temperature and the gas pressure rises abruptly. Gas for which the pressure has abruptly risen then acts as a repulsive force on the moving contact during operation. When operation of the moving contact continues so that the high-voltage arc contact and the moving arc contact make contact, frictional resistance occurs between the electrodes and there is further repulsive force exerted on the moving contact. In Japanese Utility Model Application Publication S50-46947, one contact piece of a number of arranged contact pieces (high-voltage main contacts) extends in the direction of a center axis, with a tip of the one contact piece constituting an arc-focusing contact (high-voltage arc contact).

This means that surrounding gas is heated and expands as a result of an arc occurring across the moving arc contact and the high-voltage arc contact. However, gas that has increased in temperature does not cool instantaneously directly after the arc is extinguished and the pressure of the gas that has risen abruptly does also not return to its original state instantaneously. At this stage, the moving contact is subject to two repulsive forces at the same time, repulsive force due to hot gas caused by arcing, and repulsive force due to frictional resistance. A substantial mechanical burden is therefore placed on the operation of the drive mechanism.

In the structure shown in FIG. 1 of Japanese Utility Model Application Publication S50-46947, a fixed angle taper is provided from the tip of the arc-focusing contact to the main contact section. This means that the moving contact continues to be subject to a substantial repulsive force in the direction of insertion as a result of substantial frictional resistance between the contacts directly after the moving contact makes contact.

SUMMARY OF THE INVENTION

It is an object of the present invention to at least partially solve the problems in the conventional technology.

According to an aspect of the present invention, there is provided a grounding switch that includes a high-voltage electrode and an earth electrode located facing each other along a same center axis within tanks that encapsulate an insulating gas; a moving contact that is electrically connected to the earth electrode and that is capable of being reciprocally driven along the center axis; a moving arc contact provided at an end part of the high-voltage electrode at the moving contact; a plurality of high-voltage contacts, each having a high-voltage main contact that make contact with the moving contact in a closed state, electrically connected to the high-voltage electrode, and arranged along a circumferential direction taking the center axis as a center; a high-voltage arc contact, provided at least one of the high-voltage contacts, provided further towards the side of the moving electrode than the position of the high-voltage main contacts at the end part of the high-voltage contact; and a drive mechanism that reciprocally drives the moving contact in the direction of the center axis. A valley section is provided between the high-voltage arc contact and the high-voltage main contact at the high-voltage contact such that the moving arc contact does not make contact with the valley section.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of a grounding switch of the present invention are explained in detail with reference to the drawings. The invention is by no means limited to the embodiments.

Figure 1:
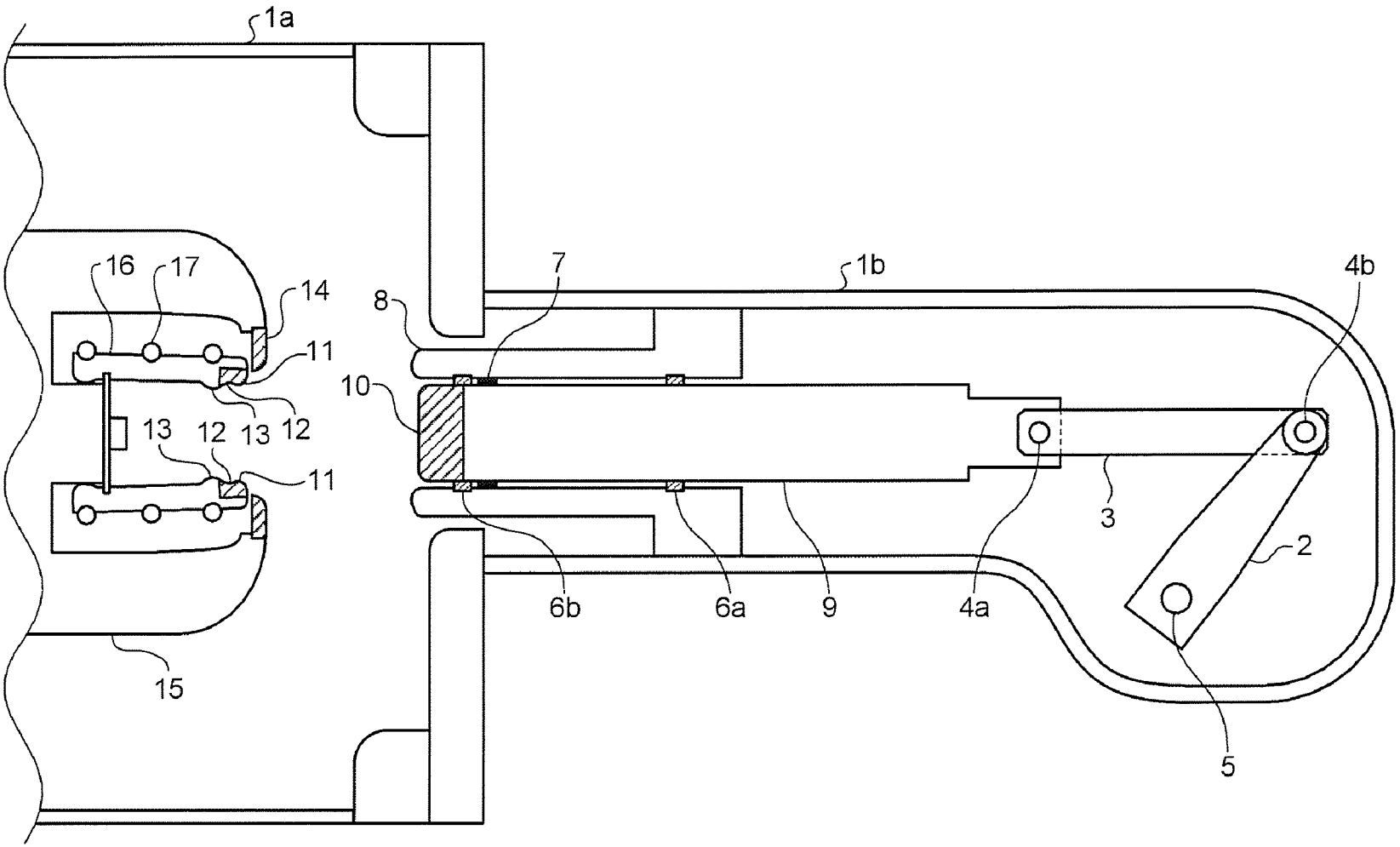
FIG. 1 is a cross-section of an open state of a grounding switch according to a first embodiment of the present invention.
Figure 2:
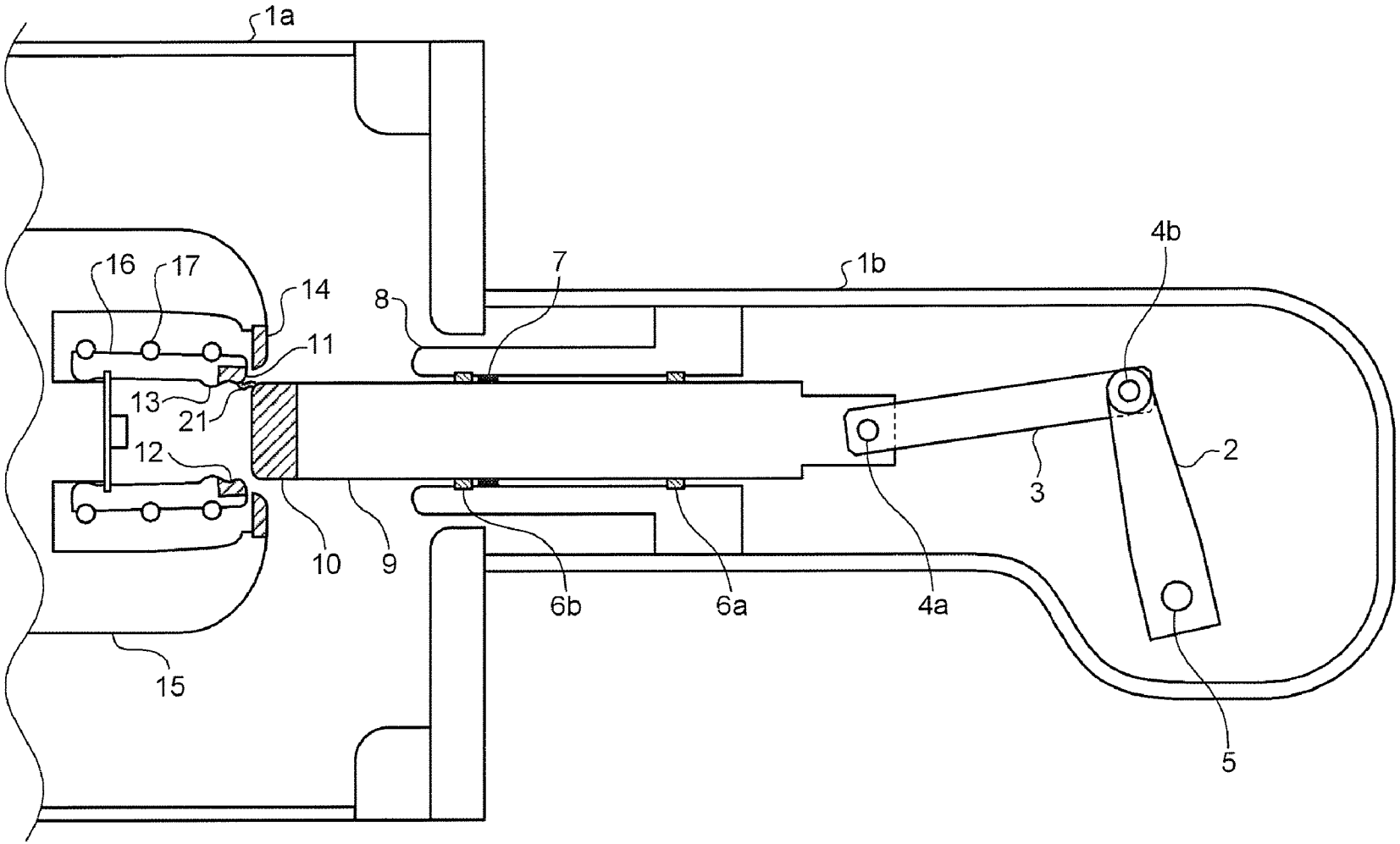
FIG. 2 is a cross-section of a situation where an arc occurs across a high-voltage arc contact and a moving arc contact when the grounding switch of FIG. 1 is midway through going from an open state to a closed state.
Figure 3:
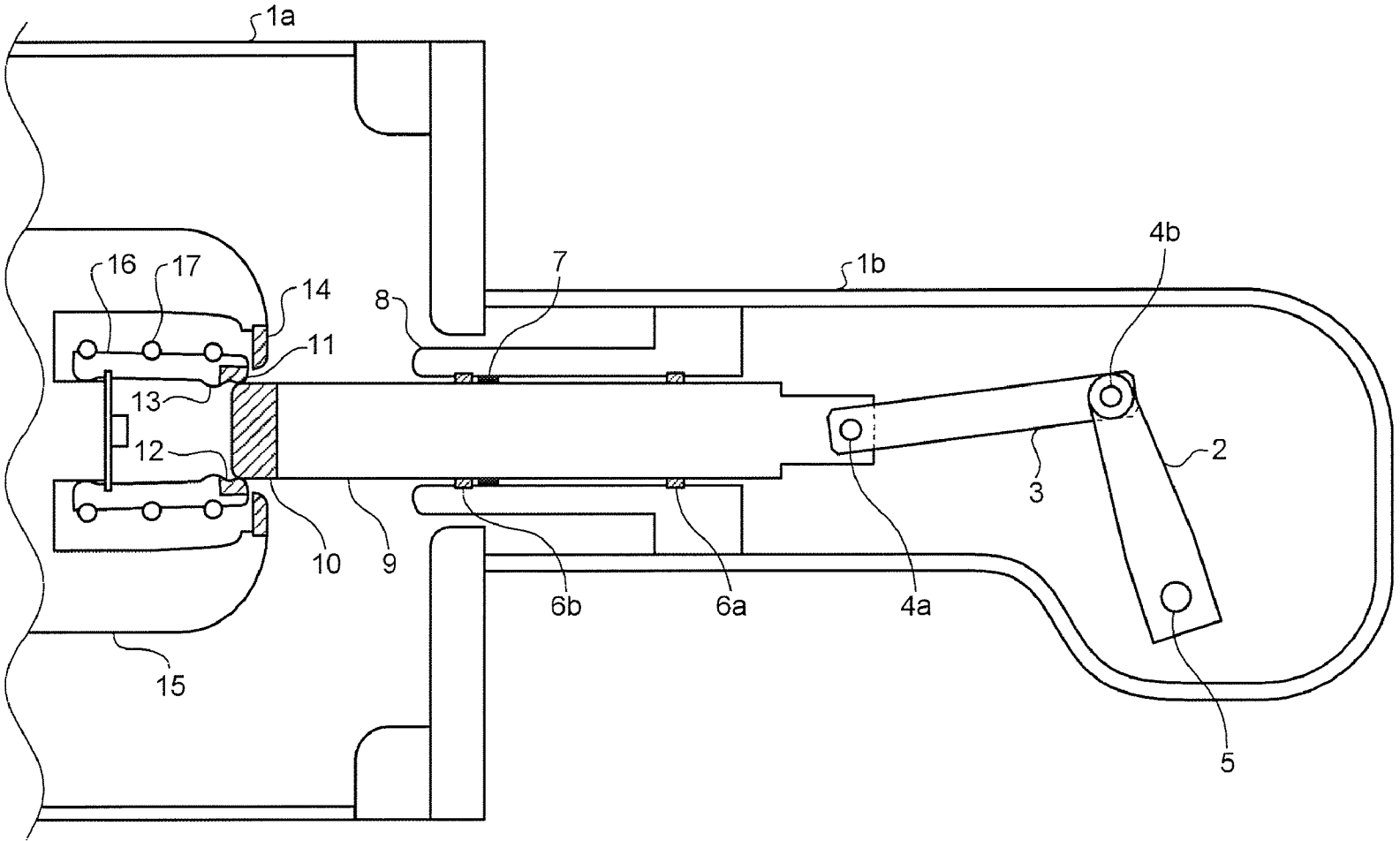
FIG. 3 is a cross-section of a situation where the moving arc contact and the high-voltage arc contact make contact when the grounding switch of FIG. 1 is midway through going from an open state to a closed state.
Figure 4:
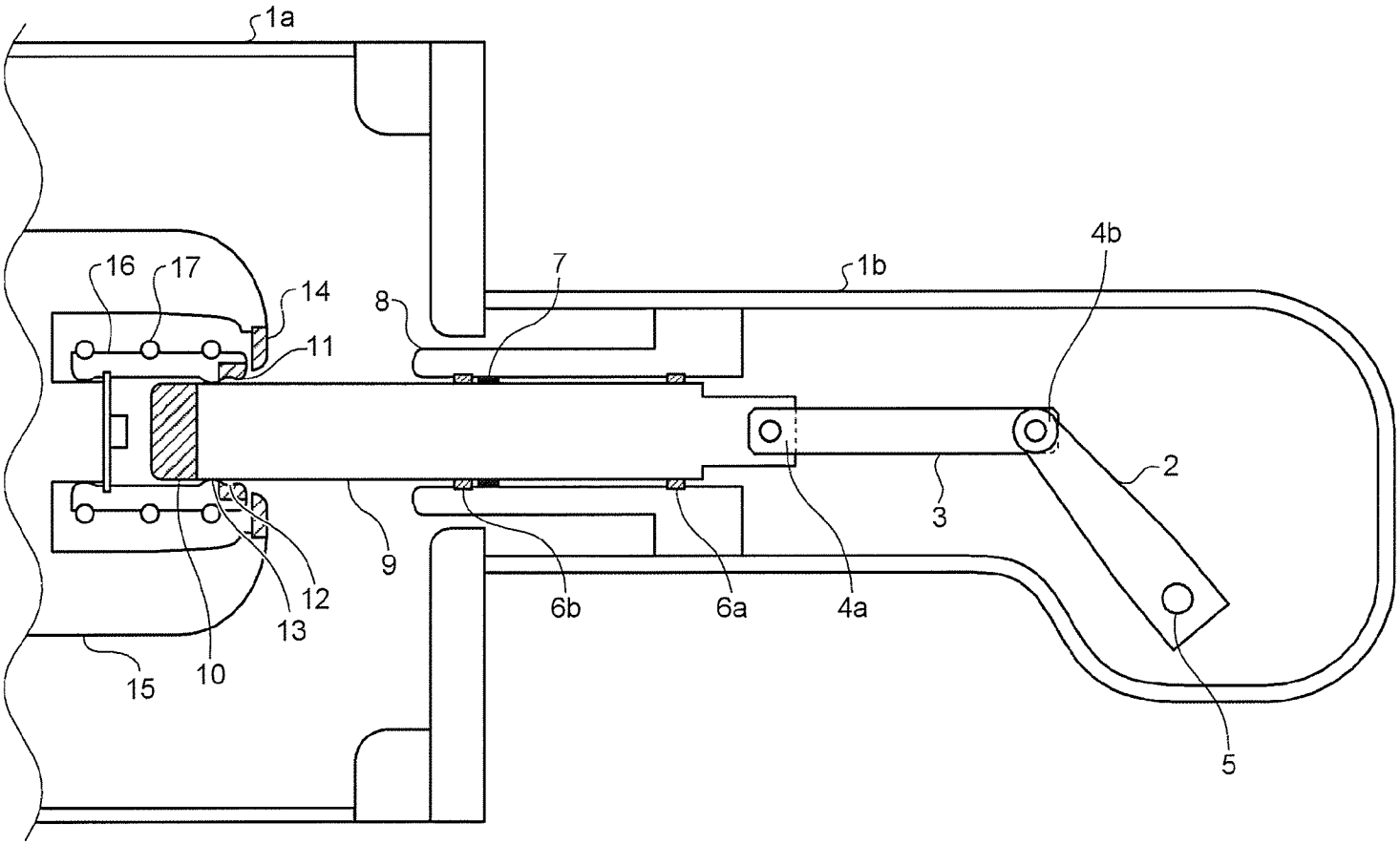
FIG. 4 is a cross-section of a closed state of the grounding switch of FIG. 1.

FIG. 1 is a cross-section of an open state of a grounding switch according to a first embodiment of the present invention. FIG. 2 is a cross-section of a situation where an arc occurs across a high-voltage arc contact and a moving arc contact when the grounding switch of FIG. 1 is midway through going from an open state to a closed state. FIG. 3 is a cross-section of a situation where the moving arc contact and the high-voltage arc contact make contact when the grounding switch of FIG. 1 is midway through going from an open state to a closed state. FIG. 4 is a cross-section of a closed state of the grounding switch of FIG. 1. In the grounding switch of the first embodiment, a high-voltage electrode 15 and an earth electrode 8 are housed in a tank 1*a* and a tank 1*b*, respectively, that encapsulate insulating gas such as sulphur hexafluoride (SF6) gas having superior electrical insulating and arc suppressing properties at a gas pressure in the order of a few Pascal. The high-voltage electrode 15 and the earth electrode 8 are arranged facing each other on the same central axis line.

A rotating shaft 5 extends to the outside of the tank (in a vertical direction with respect to the page surface) in such a manner that the insulating gas within the tank 1*b* does not leak to the outside. The rotating shaft 5 communicates with a drive mechanism (not shown), which is located outside of the tank 1*b*, enabling the grounding switch to operated by using the drive mechanism. One end of a lever 2 that rotates centrally about the rotating shaft 5 is coupled to one end of a link 3 via a pin 4*b*. The other end of the link 3 is coupled to one end of a moving contact 9 via a pin 4*a*. An earth main contact 7 is provided on the earth electrode 8 between bearings 6*a*, 6*b* that support the moving contact 9 on the earth electrode 8. This earth main contact 7 is capable of sliding with respect to the moving contact 9. The moving contact 9 and the earth electrode 8 are electrically connected via the earth main contact 7. The earth electrode 8 is fixed to and electrically connected to the tank 1*b* and is held at ground potential together with the moving contact 9. The moving contact 9 is supported by the bearings 6*a*, 6*b* so as to maintain a sliding relationship and reciprocal movement along a central axis line is possible.

The high-voltage electrode 15 is electrically connected to the main circuit and is routinely applied with a high voltage from the main circuit. A number of high-voltage contacts 16 are arranged equidistantly along a circumferential direction (specifically, a circumferential direction within a plane perpendicular to the central axis line taking the center axis as center) of a central axis line within the high-voltage electrode 15 and are electrical shielded with respect to outside. One end of each of the high-voltage contacts 16 is electrically connected to the high-voltage electrode 15, and the other end is electrically connected to a high-voltage main contact 13 that connects to and disconnects from the moving contact 9. Further, high-voltage arc contacts 11 are provided at end parts on the side making contact with the moving contact 9 at some of the high-voltage contacts 16. The high-voltage arc contacts 11 are also provided equidistantly spaced along the circumferential direction. A moving arc contact 10 is provided at an end part on the side making contact with the high-voltage contacts 16 at the moving contact 9. The high-voltage main contact 13 and the high-voltage arc contacts 11 are formed in a twin-peak shape with a valley section 12 in between. Further, the high-voltage arc contacts 11 arranged at positions (position further distanced from the center axis) further away in a radial direction with respect to the center axis from the high-voltage main contact 13. When the moving contact 9 makes contact with the high-voltage arc contacts 11, the bottom part of the valley section 12 is positioned further to the outside with respect to the central axis than the external diameter of the moving contact 9 and a gap is present between the valley section 12 and the moving contact 9. The high-voltage contacts 16, which are arranged in the circumferential direction, maintain a contact pressure with respect to the moving contact 9 because of gutter springs 17 that are wrapped around the periphery thereby realizing stable earthing and energizing. An anti-arcing shield is also arranged so as to cover the high-voltage arc contacts 11 at the high-voltage electrode 15 in the vicinity of the high-voltage arc contacts 11. This means that even if an arc lets fly at this unit, marked damage to the high-voltage electrode 15 is suppressed and withstand voltage performance is not degraded.

Figure 5A:
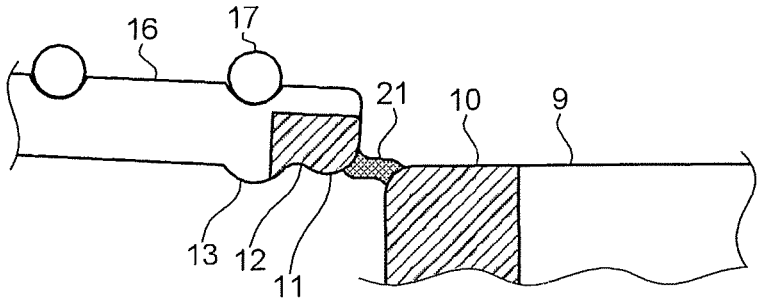
FIG. 5A is a cross-section of the essential parts of FIG. 2 depicting the situation when an arc occurs across the high-voltage arc contact and the moving arc contact when the grounding switch is in the middle of moving from an open state to a closed state.
Figure 5B:
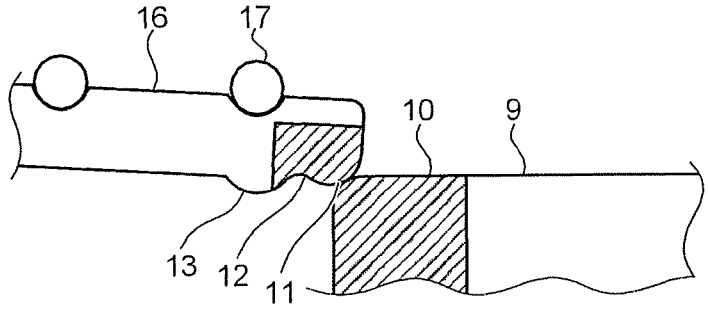
FIG. 5B is a cross-section of the essential parts of FIG. 3 depicting a situation where the moving arc contact and the high-voltage arc contact make contact when the grounding switch is midway through going from an open state to a closed state.
Figure 5C:
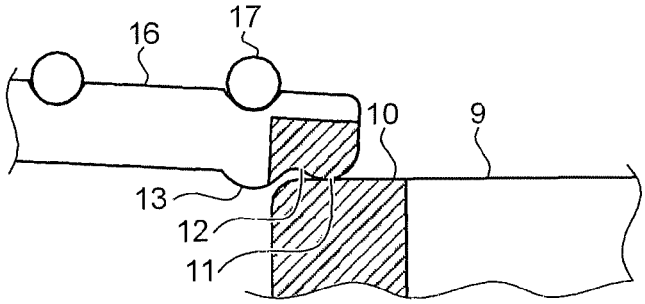
FIG. 5C is a cross-section of the essential parts depicting a state where a moving arc contact is positioned between the tip of a high-voltage arc contact and a high-voltage main contact.
Figure 5D:
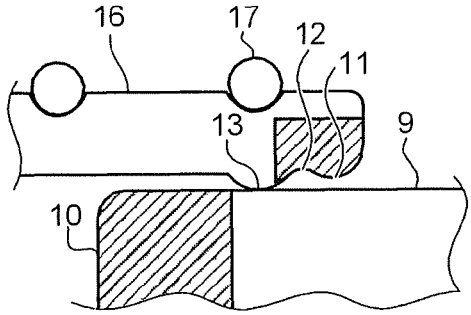
FIG. 5D is a cross-section of the essential parts of FIG. 4 depicting a closed state of the grounding switch.

Next, the operation is explained with reference to FIG. 1 to FIG. 5D. FIG. 5A is a cross-section of the essential parts of FIG. 2 depicting the situation when an arc occurs across the high-voltage arc contacts 11 and the moving arc contact 10 when the grounding switch is in the middle of moving from an open state to a closed state. FIG. 5B is a cross-section of the essential parts of FIG. 3 depicting a situation where the moving arc contact 10 and the high-voltage arc contacts 11 make contact when the grounding switch is midway through going from an open state to a closed state. FIG. 5C is a cross-section of the essential parts depicting a state where the moving arc contact 10 is between the tip of the high-voltage arc contacts 11 and the high-voltage main contact 13. FIG. 5D is a cross-section of the essential parts of FIG. 4 depicting a closed state of the grounding switch.

In the state shown in FIG. 1, the earth electrode 8 is at earth potential and a high voltage is applied to the high-voltage electrode 15. First, the lever 2 is subjected to a drive force from the drive mechanism via the rotating shaft 5 so that the lever 2 rotates in the anti-clockwise direction. As a result, the moving contact 9 moves in the direction of the high-voltage electrode 15 along a central axis line of the grounding switch via the link 3.

As shown in FIG. 2 and FIG. 5A, when the movement of the moving contact 9, which is at an earth potential, continues towards the high-voltage electrode 15, which is at the high voltage, breakdown of electrical insulation occurs just prior to making contact with the high-voltage arc contacts 11 because of dwindling of the distance between the moving arc contact 10 and the high-voltage arc contacts 11. An arc 21 therefore occurs across the moving arc contact 10 and the high-voltage arc contacts 11 or an arc-resistant shield 14. This arc 21 heats the surrounding gas, which causes an instantaneous rise in the gas pressure surrounding the arc. In particular, just prior to the moving contact 9 making contact with the high-voltage arc contacts 11, a cavity, which contains gas, within the high-voltage electrode 15 becomes half-closed due to the moving contact 9 and the path of gas to the outside narrows. When the arc 21 occurs in this situation, the gas pressure in the cavity of the high-voltage electrode 15 rises abruptly. The abrupt rise in gas pressure results in a repulsive force with respect to the act of insertion of the moving contact 9 inside the cavity of the high-voltage electrode 15.

Moreover, as shown in FIG. 5B, when the moving contact 9 continues to move, the moving arc contact 10 and the high-voltage arc contacts 11 make contact while forming an arbitrary contact angle larger than 0 degrees with respect to the center axis and the arc 21 is extinguished. After the arc is extinguished, the repulsive force exerted on the moving contact 9 continues for a while in the course of attenuating; because, the gas pressure inside the cavity of the high-voltage electrode 15 does not immediately return to a normal state. In due course, as the moving arc contact 10 moves further inside the cavity of the high-voltage electrode 15, it pushes out the high-voltage arc contacts 11 of the high-voltage contacts 16 with the gutter springs 17 wrapped around.

As shown in FIG. 5C, when the end part of the moving arc contact 10 reaches the valley section 12 of the high-voltage arc contacts 11, the moving contact 9 is completely inserted at the high-voltage arc contacts 11. A frictional resistance only that is proportional to the contact pressure to the side surface of the moving contact 9 then acts as a repulsive force without further pushing. The repulsive force in the direction of insertion during sliding of the arc contact is smaller for the arc contact of the high-voltage contacts 16 compared to the repulsive force of a fixed angle taper shape that does not have the valley section 12.

As the moving contact 9 moves further, as shown in FIG. 5D, the grounding switch is closed and the high-voltage main contact 13 and the moving contact 9 make contact. Further, the high-voltage arc contacts 11 are made to be at a position further away in a radial direction with respect to a center axis than the high-voltage main contact 13. The high-voltage arc contacts 11 are in a state of not making contact with the moving contact 9 and the contact resistance value when energized is stable.

Figure 6:
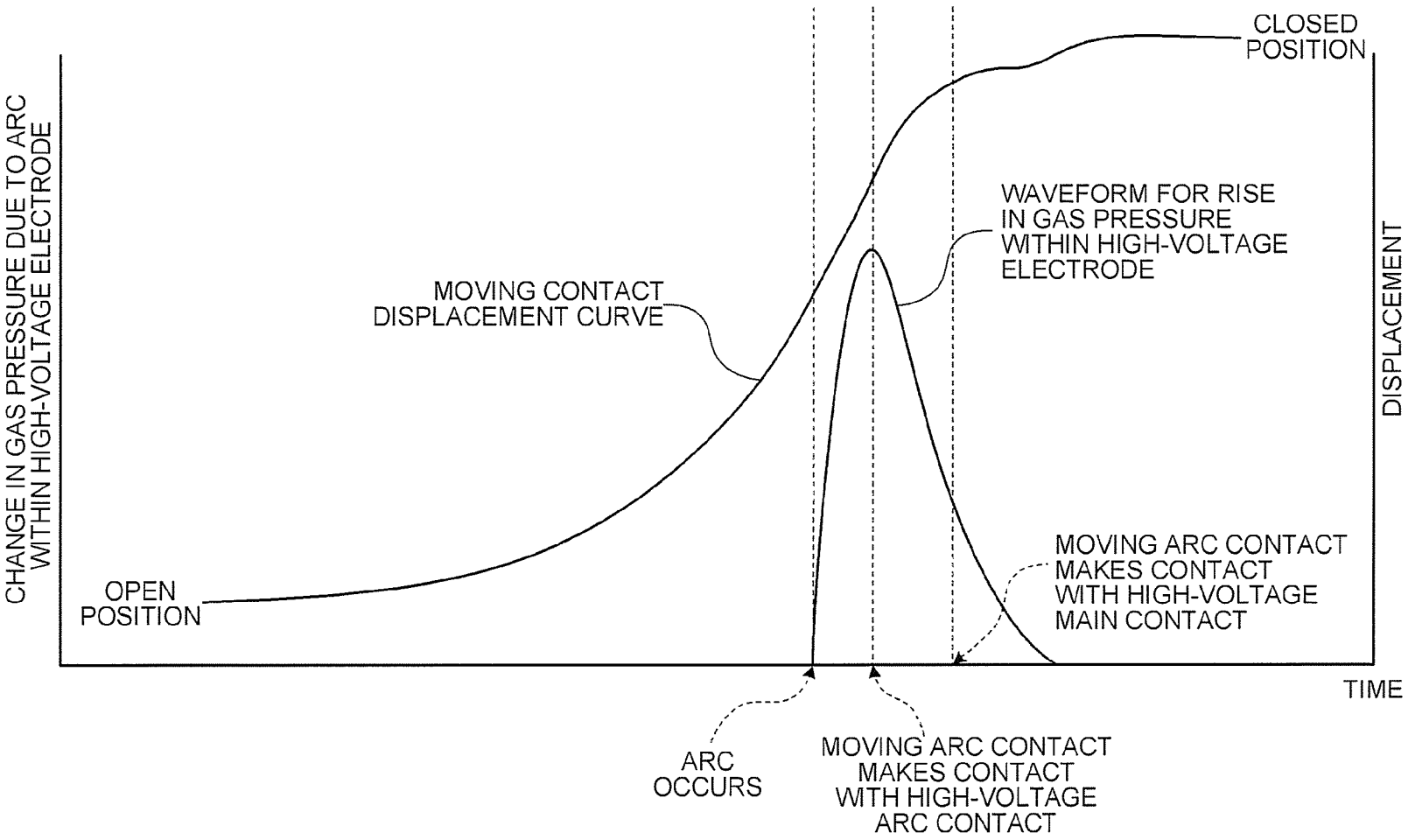
FIG. 6 is a graph depicting a relationship between position of a moving contact, gas pressure within the high-voltage electrode, and time occurring in the process when the grounding switch goes from an open state to a closed state according to the first and second embodiments of the present invention.

Changes in the gas pressure inside the cavity of the high-voltage electrode 15 when the grounding switch is erroneously thrown on are explained together with a displacement—time characteristic of the moving contact 9. FIG. 6 is a graph depicting a relationship between position of the moving contact 9, gas pressure inside the cavity of the high-voltage electrode 15, and time occurring in the process when the grounding switch goes from open to closed. Gas pressure inside the cavity of the high-voltage electrode 15 rises abruptly after an arc occurs in the state shown in FIG. 5A. Repulsive force exerted on the moving contact 9 due to hot gas is proportional to a rise in gas pressure within the high-voltage electrode 15. Repulsive force due to the gas pressure and the hot gas inside the cavity of the high-voltage electrode 15 reaches a peak at around a time point at which the moving arc contact 10 makes contact with the high-voltage arc contacts 11, and attenuates after that. Attenuation of the gas pressure depends on the gas flow path surface area, the volume of the cavity of the high-voltage electrode 15, and the like. Gas relief holes (not shown) are therefore provided at the side surface and bottom surface of the high-voltage electrode 15 and surface area of an exhaust is adjusted. The repulsive force due to the gas pressure inside the high-voltage electrode 15 and the hot gas going to the moving contact 9 is substantially reduced from the peak time at a time point at which the moving arc contact 10 makes contact with the high-voltage main contact 13.

The durations for abrupt rise and fall of the gas pressure are only in the order of a few milliseconds in either case. The speed of the moving contact 9 is in the order of a few m/s. The distance from the arc occurring to the moving arc contact 10 making contact with the high-voltage arc contacts 11 is from a few millimeters to tens-odd millimeters. The arcing time during this time is therefore made as short as possible. Further, after the arc is extinguished, a dimension is adopted that ensures that the moving arc contact 10 makes contact with the high-voltage main contact 13 at a time where the gas pressure has fallen sufficiently. The gap between the high-voltage arc contact 11 and the high-voltage main contact 13 is therefore similarly taken to be in the order of a few millimeters to a number of tens of millimeters.

The grounding switch is thus provided with the valley section 12 at the high-voltage contacts 16. Because of this valley section 12, the grounding switch has a reduced sum of repulsive force due to hot gas caused by the arc 21 across the moving arc contact 10 and the high-voltage arc contacts 11 when high voltage is applied to the main circuit and the moving contact 9 is erroneously thrown on and a repulsive force in a direction of insertion due to the moving contact 9 advancing so as to push out the high-voltage contacts 16. Consequently, the mechanical burden on the drive mechanism is reduced and the operation energy is also lowered.

It is preferable to arrange a plurality of the high-voltage arc contacts 11. This enables the resistance to arcing to be further improved.

It is preferable to arrange a number of the high-voltage arc contacts 11 equidistantly along the circumferential direction. In such a configuration, the moving contact 9 can reliably make contact with any of the high-voltage arc contacts even in cases of eccentricity due to variation in the dimension of parts or errors in assembly for the moving contact 9.

Figure 7:
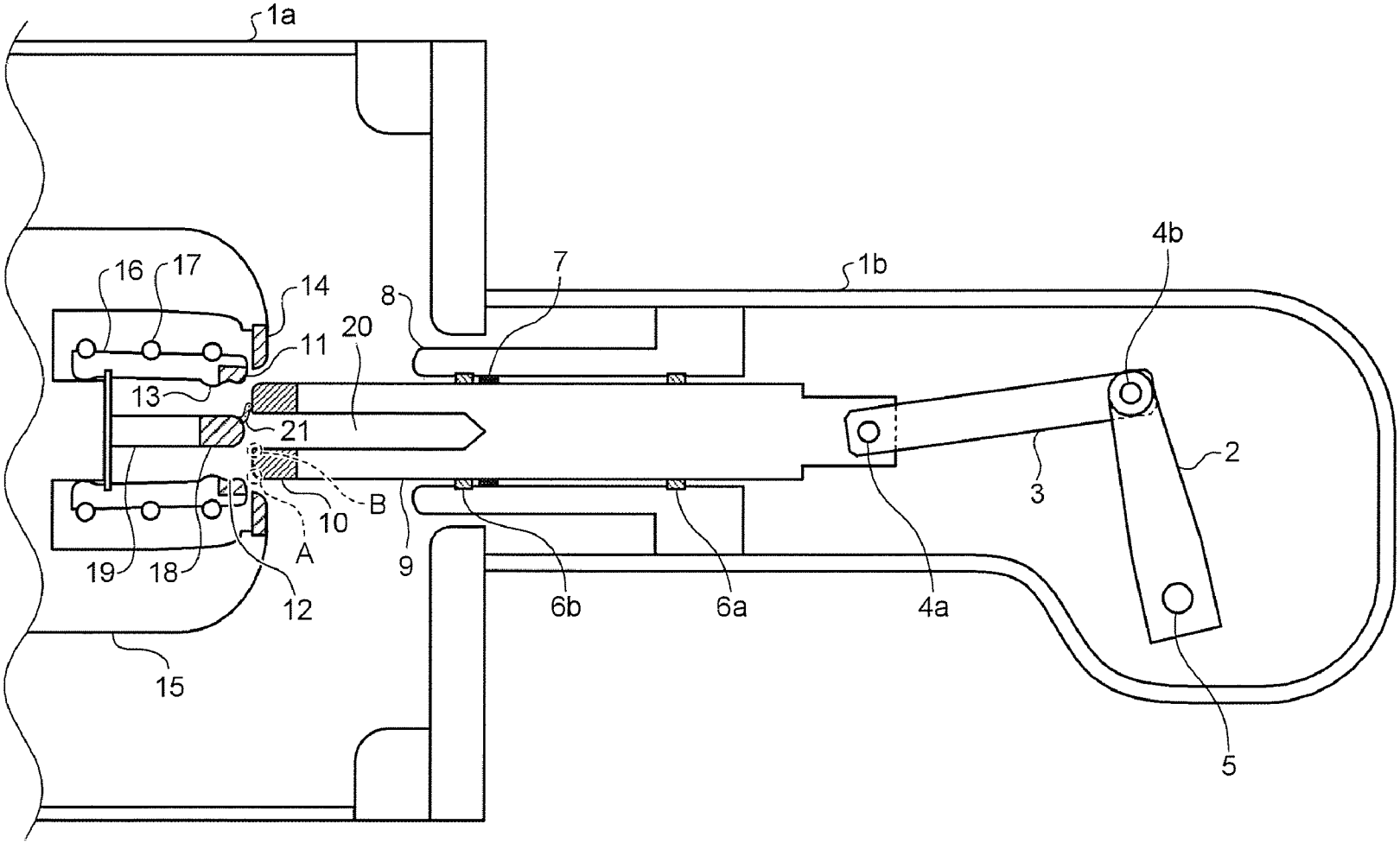
FIG. 7 is a cross-section of the grounding switch of the second embodiment and is a cross-section of the situation when an arc occurs across a moving arc contact and a high-voltage arc electrode when the grounding switch is midway through going from an open state to a closed state.

FIG. 7 is a cross-section of a grounding switch according to a second embodiment of the present invention and is a cross-section of the situation when an arc occurs across the moving arc contact 10 and a high-voltage arc electrode 19 when the grounding switch is in the middle of changing from an open state to a closed state.

In the structure of this embodiment, in addition to the structure of the first embodiment, the high-voltage arc electrode 19 extending in a center axis direction is located at a central part of the high-voltage electrode 15 and an arc contact 18 is located at the tip of the high-voltage arc electrode 19. Further, a hole 20 open to the side of the high-voltage arc electrode 19 is provided at the moving contact 9 and the moving arc contact 10. This hole 20 is formed to a predetermined depth along a center axis direction from the end of the moving contact 9. By providing the hole 20 centrally between the moving arc contact 10 and the moving contact 9, the moving arc contact 10 and the moving contact 9 are given a structure where there is no contact between the arc contact 18 of the high-voltage arc electrode 19 and the high-voltage arc electrode 19 when the grounding switch is in a closed state. Further, at the end of the moving arc contact 10, a radius of curvature (for example, the radius of curvature of the portion shown in B of FIG. 7) on the inside facing the high-voltage arc electrode 19 is made smaller than the radius of curvature (for example, radius of curvature of the portion shown in A of FIG. 7) of the outside facing the high-voltage arc contacts 11. The electrical field of the moving arc contact 10 facing the arc contact 18 of the high-voltage arc electrode 19 is therefore larger than the electrical field of the moving arc contact 10 facing the high-voltage arc contacts 11. The shape of the end part of the moving contact 9 and the shape of the end part of the high-voltage arc electrode 19 is not limited to the examples shown in the drawings providing that the electrical field across the arc contact 18 of the high-voltage arc electrode 19 is larger than the electrical field across the high-voltage arc contacts 11 and the moving arc contact 10. Other aspects of the structure are the same as for the first embodiment.

Next, an explanation is given of the operation. Up to immediately before an arc occurring, the operation is the same as for the first embodiment. The arc 21 then occurs across the moving arc contact 10 and the arc contact 18 of the high-voltage arc electrode 19 and the gas pressure rises. When movement of the moving contact 9 then continues in a straight line in the direction of insertion, the moving arc contact 10 makes contact with the high-voltage arc contacts 11 and the arc 21 is extinguished. The operation from then on is the same as for the first embodiment. In a closed state, the high-voltage arc electrode 19 and the arc contact 18 are housed within the hole 20.

With the grounding switch of the second embodiment, in addition to the effects of the first embodiment, by making the electrical field across the moving arc contact 10 and the arc contact 18 of the high-voltage arc electrode 19 large so that an arc occurs across the moving arc contact 10 and the arc contact 18 of the high-voltage arc electrode 19, it is possible to more reliably prevent the flying of the arc 21 to the arc-resistant shield 14 or to the high-voltage main contact 13 positioned in the vicinity of the high-voltage arc contacts 11.

According to an aspect of the present invention, a valley section is provided across a high-voltage arc contact and a high-voltage main contact and the moving arc contact does not make contact with the valley section in the middle of operation of the moving contact. It is therefore possible to reduce frictional resistance occurring between the moving contact and the high-voltage contact while moving the moving arc contact from making contact with the high-voltage arc contact to making contact with the high-voltage main contact. This means that even if high voltage is applied to the main circuit, the moving contact is erroneously thrown on, and an arc occurs across the high-voltage arc contact and the moving arc contact, the sum of the repulsive force due to the hot gas and the repulsive force due to the frictional resistance is reduced for from when the moving arc contact makes contact with the high-voltage arc contact until contact is made with the high-voltage main contact, i.e. until the arc cools and the surrounding gas pressure falls. The mechanical load on the drive mechanism is therefore alleviated and operation energy of the drive mechanism required for successful completion of an erroneous ON operation can be reduced.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A grounding switch comprising:

a high-voltage electrode and an earth electrode located facing each other along a same center axis within tanks that encapsulate an insulating gas;

a moving contact that is electrically connected to the earth electrode and that is capable of being reciprocally driven along the center axis;

a moving arc contact provided at an end part of the high-voltage electrode at the moving contact;

a plurality of high-voltage contacts, each having a high-voltage main contact that makes contact with the moving contact in a closed state, electrically connected to the high-voltage electrode, and arranged along a circumferential direction taking the center axis as a center;

a high-voltage arc contact, provided at at least one of the high-voltage contacts, provided further towards a side of the earth electrode than a position of the high-voltage main contacts at the end part of the high-voltage contact;

an anti-arcing shield arranged to cover the high-voltage arc contact at the high-voltage electrode in a vicinity of the high voltage arc contact while avoiding direct contact with the high-voltage arc contact; and a drive mechanism that reciprocally drives the moving contact in the direction of the center axis, wherein a valley section is provided between the high-voltage arc contact and the high-voltage main contact at the high-voltage contact such that the moving arc contact does not make contact with the valley section.

2. The grounding switch according to claim 1, wherein the high-voltage arc contact is provided in a plurality.

3. The grounding switch according to claim 2, wherein the high-voltage arc contacts are arranged equidistantly along a circumferential direction taking the center axis as a center.

4. The grounding switch according to claim 1, further comprising a high-voltage arc electrode arranged at a central part of the high-voltage electrode, and end parts of the high-voltage arc electrode and the moving contact are formed in shapes that cause the electrical field across the moving arc contact and the high-voltage arc electrode to be larger than the electrical field across the moving arc contact and the high-voltage arc contact.

5. The grounding switch according to claim 2, further comprising a high-voltage arc electrode arranged at a central part of the high-voltage electrode, and end parts of the high-voltage arc electrode and the moving contact are formed in shapes that cause the electrical field across the moving arc contact and the high-voltage arc electrode to be larger than the electrical field across the moving arc contact and the high-voltage arc contact.

6. The grounding switch according to claim 3, further comprising a high-voltage arc electrode arranged at a central part of the high-voltage electrode, and end parts of the high-voltage arc electrode and the moving contact are formed in shapes that cause the electrical field across the moving arc contact and the high-voltage arc electrode to be larger than the electrical field across the moving arc contact and the high-voltage arc contact.

7. The grounding switch according to claim 1, wherein the earth electrode is fixed to a respective tank so that the earth electrode is stationary with respect to the respective tank.

* * * * *